US012442054B2

(12) United States Patent
Nakamura et al.

(10) Patent No.: US 12,442,054 B2
(45) Date of Patent: Oct. 14, 2025

(54) AUSTENITIC STAINLESS CAST STEEL AND METHOD FOR PRODUCING AUSTENITIC STAINLESS CAST STEEL

(71) Applicant: MITSUBISHI HEAVY INDUSTRIES ENGINE & TURBOCHARGER, LTD., Sagamihara (JP)

(72) Inventors: Tadaaki Nakamura, Tokyo (JP); Nobuhiko Saito, Tokyo (JP); Nobuyoshi Komai, Tokyo (JP); Keita Hashimoto, Tokyo (JP); Yuya Konno, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 420 days.

(21) Appl. No.: 18/018,021

(22) PCT Filed: Sep. 6, 2021

(86) PCT No.: PCT/JP2021/032593
§ 371 (c)(1),
(2) Date: Jan. 25, 2023

(87) PCT Pub. No.: WO2022/113466
PCT Pub. Date: Jun. 2, 2022

(65) Prior Publication Data

US 2023/0272496 A1 Aug. 31, 2023

(30) Foreign Application Priority Data

Nov. 27, 2020 (JP) ..... 2020-197385

(51) Int. Cl.
*C21D 6/02* (2006.01)
*C21D 6/00* (2006.01)
(Continued)

(52) U.S. Cl.
CPC ..... *C21D 6/02* (2013.01); *C21D 6/004* (2013.01); *C22C 38/002* (2013.01); *C22C 38/02* (2013.01);
(Continued)

(58) Field of Classification Search
CPC .... C21D 6/02; C21D 6/004; C21D 2211/001; C21D 2211/004; C21D 1/28; C21D 1/84;
(Continued)

(56) References Cited

U.S. PATENT DOCUMENTS 3,826,689 A 7/1974 Ohta et al.
4,798,632 A 1/1989 Yonezawa et al.
(Continued)

FOREIGN PATENT DOCUMENTS

CN 101560626 A 10/2009
DE 2 211 229 9/1972
(Continued)

OTHER PUBLICATIONS

International Search Report for International Application No. PCT/JP2021/032593, dated Nov. 22, 2021, with English translation.
(Continued)

*Primary Examiner* — Adil A. Siddiqui
(74) *Attorney, Agent, or Firm* — WENDEROTH, LIND & PONACK, L.L.P.

(57) ABSTRACT

In this cast austenitic stainless steel, in a cross section when heated at 1000° C., an average number Nc per unit area of carbides having an equivalent circle diameter of 500 nm or larger in a center portion of an austenite crystal grain is $6.0\times10^{-2}$ particles/$\mu m^2$ or more, and, when an average number per unit area of the carbides having an equivalent circle diameter of 500 nm or larger in a vicinity of a grain boundary in an austenite crystal grain is represented as Ngb, Ngb/Nc is 1.3 or less.

6 Claims, 3 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/48*** | (2006.01) |

(52) U.S. Cl.
CPC ..... *C22C 38/04* (2013.01); *C22C 38/44* (2013.01); *C22C 38/48* (2013.01); *C21D 2211/001* (2013.01); *C21D 2211/004* (2013.01)

(58) Field of Classification Search
CPC ..... C21D 8/005; C21D 1/26; C22C 38/002; C22C 38/02; C22C 38/04; C22C 38/44; C22C 38/48; C22C 30/00; C22C 38/58
See application file for complete search history.

(56) References Cited

U.S. PATENT DOCUMENTS

| | | | | |
|---|---|---|---|---|
| 2010/0303669 | A1* | 12/2010 | Pankiw | C22C 38/02 73/866 |
| 2019/0112694 | A1* | 4/2019 | Takagi | C22C 38/46 |

FOREIGN PATENT DOCUMENTS

| | | | |
|---|---|---|---|
| JP | 54-19416 | A | 2/1979 |
| JP | 55-31166 | | 8/1980 |
| JP | 57-32348 | A | 2/1982 |
| JP | 58-167726 | A | 10/1983 |
| JP | 61-238913 | A | 10/1986 |
| JP | 62-167839 | A | 7/1987 |
| JP | 62-50549 | B2 | 10/1987 |
| JP | 7-70700 | | 3/1995 |
| JP | 10-110215 | A | 4/1998 |

OTHER PUBLICATIONS

Silva et al., "Dissolution of Grain Boundary Carbides by the Effect of Solution Annealing Heat Treatment and Aging Treatment on Heat-Resistant Cast Steel HK30," Metals, vol. 7, No. 251, Jul. 5, 2017, pp. 1-12.

Written Opinion of the International Searching Authority for International Application No. PCT/JP2021/032593, dated Nov. 22, 2021, with English translation.

* cited by examiner

AUSTENITIC STAINLESS CAST STEEL AND METHOD FOR PRODUCING AUSTENITIC STAINLESS CAST STEEL

TECHNICAL FIELD

The present disclosure relates to a cast austenitic stainless steel (a cast steel of an austenitic stainless steel) and a method for producing a cast austenitic stainless steel. The present application claims priority on Japanese Patent Application No. 2020-197385 filed on Nov. 27, 2020, the content of which is incorporated herein by reference.

BACKGROUND ART

Turbochargers or gas turbines reach high temperatures during use. Therefore, materials that are used for turbochargers or gas turbines are required to have excellent heat resistance such as oxidation resistance, high strength at high temperatures and thermal fatigue properties.

Materials that satisfy the heat resistance condition are austenitic stainless steel or Ni-based alloys. For example, Patent Document 1 discloses a nozzle for a gas turbine that is composed of a cast metal containing Ni as a main element, a necessary amount of Cr for high-temperature corrosion resistance and a necessary amount of a solid solution strengthening element for solid solution strengthening that is a carbide-forming element and has a structure in which eutectic carbides and secondary carbides with a desired size are dispersed in the matrix.

PRIOR ART DOCUMENTS

Patent Document

Patent Document 1: Japanese Unexamined Patent Application, First Publication No. 857-32348

DISCLOSURE OF INVENTION

Problems to be Solved by the Invention

However, the nozzle for a gas turbine disclosed in Patent Document 1 is formed of an expensive Ni-based alloy, and a lower-cost material is in demand. In addition, currently, there is a tendency for the temperature of exhaust gas to increase in order to improve fuel economy performance, and turbochargers are required to have heat resistance at higher temperatures than conventional cast austenitic stainless steel.

The present disclosure has been made in order to solve the above-described problems, and an object of the present invention is to provide a low-cost cast austenitic stainless steel having excellent heat resistance and a method for producing the same.

Solutions for Solving the Problems

In a cast austenitic stainless steel according to the present disclosure, in a cross section when heated at 1000° C., an average number Nc per unit area of carbides having an equivalent circle diameter of 500 nm or larger is $6.0\times10^{-2}$ particles/$\mu m^2$ or more, and, when an average number per unit area of the carbides having an equivalent circle diameter of 500 nm or larger in a vicinity of a grain boundary in an austenite crystal grain is represented as Ngb, Ngb/Nc is 1.30 or less.

A method for producing a cast austenitic stainless steel according to the present disclosure includes a heating step of heating a cast austenitic stainless steel after casting at a heating temperature of 1100° C. to 1250° C.

Effects of Invention

According to the above-described aspects of the present disclosure, it is possible to provide a low-cost cast austenitic stainless steel having excellent heat resistance and a method for producing the same.

EMBODIMENTS FOR CARRYING OUT THE INVENTION

As a result of intensive studies about improvement in heat resistance, the present inventors found the following matters.

(1) In a conventional cast austenitic stainless steel, there are cases where cracking occurs due to repetitive thermal stress.

Figure 5:
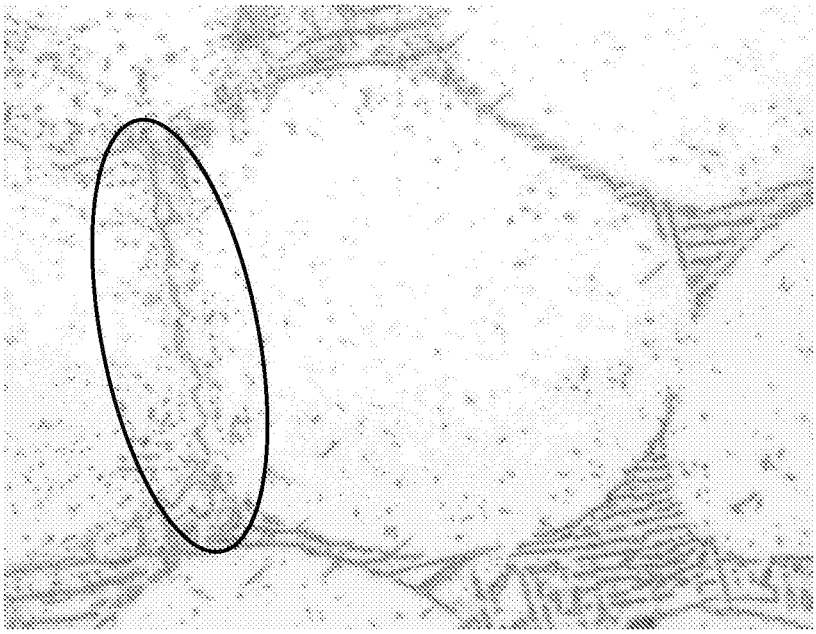
FIG. 5 is an optical microscopic image of a conventional cast austenitic stainless steel after heating.

(2) In a conventional cast austenitic stainless steel, as shown in a region surrounded by a circle in FIG. 5, excess carbides precipitate in the vicinity of a grain boundary in an austenite crystal grain due to heating.

(3) In the case of a conventional cast austenitic stainless steel, due to the precipitation of excess carbides in the vicinity of the grain boundary in the austenite crystal grain, the cast austenitic stainless steel embrittles, and a fissure propagates along intergranular carbides.

As a result of intensive studies based on the above-described analysis, the present inventors obtained the following knowledges.

(A) In a cross section of the cast austenitic stainless steel after heating, when the average number per unit area of the carbides in the center portion of an austenite crystal grain is represented as Nc, and the average number per unit area of the carbides in the vicinity of grain boundary in the austenite crystal grain is represented as Ngb, if Ngb/Nc is 1.30 or less, it is possible to suppress the embrittlement of the cast austenitic stainless steel.

The present invention determined the configuration of a cast austenitic stainless steel of the present disclosure based on the above-described knowledge. In the cast austenitic stainless steel of the present disclosure, since a precipitate is controlled by a thermal treatment, the average number Nc per unit area of the carbides having an equivalent circle diameter of 500 nm or larger in the center portion of the austenite crystal grain is $6.0\times10^{-2}$ particles/$\mu m^2$ or more. The above-described effect makes it possible for the cast austenitic stainless steel of the present disclosure to obtain high heat resistance. The vicinity of the grain boundary in the austenite crystal grain is defined as "a region up to 10 μm from the grain boundary in the austenite crystal grain", and the center portion of the austenite crystal grain is defined as "a region other than the vicinity of the grain boundary in the austenite crystal grain (a precipitation-free region is excluded)". In the present specification, numerical ranges expressed using "to" mean ranges including numerical values before and after "to" as the lower limit and the upper limit. In the present specification, temperatures such as heating temperatures are the temperatures of the surface of the cast austenitic stainless steel.

First Embodiment

A cast austenitic stainless steel according to a first embodiment will be described below.

(Nc=$6.0\times10^{-2}$ Particles/$\mu m^2$ or More)

In a cross section of the cast austenitic stainless steel according to the first embodiment when heated at 1000° C., the average number Nc per unit area of carbides having an equivalent circle diameter of 500 nm or larger in the center portion of an austenite crystal grain is $6.0\times10^{-2}$ particles/$\mu m^2$ or more. The heating time at 1000° C. is not particularly limited and is, for example, 30 minutes. The equivalent circle diameter refers to the diameter of a circle having the same area as the projected area of a particle. A more preferable average number per unit area of the carbides is $6.5\times10^{-2}$ particles/$\mu m^2$ or more. A still more preferable average number per unit area of the carbides is $7.0\times10^{-2}$ particles/$\mu m^2$ or more. In the present embodiment, since the precipitation of the carbides is controlled by a thermal treatment, the average number Nc per unit area of the carbides having an equivalent circle diameter of 500 nm or larger in the center portion of the austenite crystal grain becomes $6.0\times10^{-2}$ particles/$\mu m^2$ or more. In the cast austenitic stainless steel according to the first embodiment, Nc before heating at 1000° C. may be $6.0\times10^{-2}$ particles/$\mu m^2$ or more.

The carbide is preferably $M_{23}C_6$ when a metal element is represented as M (M: Fe, Cr or Nb) and a carbon element is represented as C. The carbide can be analyzed by, for example, energy-dispersive X-ray spectroscopy (EDX).

(Method for Measuring Nc)

Figure 1:
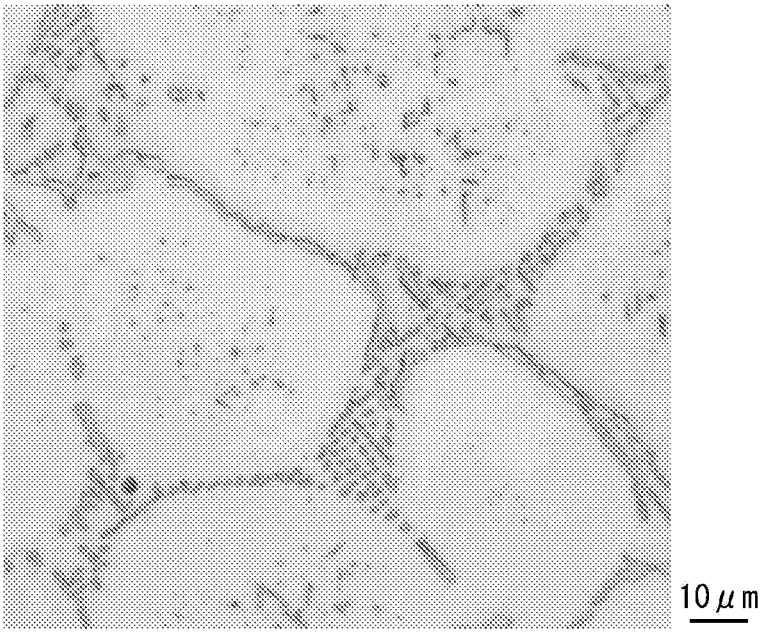
FIG. 1 is an optical microscopic image of a cast austenitic stainless steel according to a first embodiment of the present disclosure after heating.

The average number per unit area of the carbides can be measured by the following method. The cast austenitic stainless steel after being heated at 1000° C. is cut, and the cut face is etched with picric acid and hydrochloric acid and observed with an optical microscope (magnification: 1000 times). FIG. 1 is an optical microscopic image of the cast austenitic stainless steel according to the first embodiment. In the case of FIG. 1, the carbides appear as black regions in the center portion of an austenite crystal grain. At 10 arbitrary sites in the crystal grains in the obtained observation image, the number of the carbides having an equivalent circle diameter of 500 nm or larger in a perfect circle having a diameter of 10 μm is counted, and the average number Nc per unit area can be calculated from the obtained number of the carbides and the area of the regions where the carbides have been measured.

(Ngb/Nc: Less than 0.50)

In a cross section of the cast austenitic stainless steel according to the first embodiment after being heated at 1000° C., when the average number per unit area of carbides having an equivalent circle diameter of 500 nm or larger in the center portion of an austenite crystal grain is represented as Nc, and the average number per unit area of carbides having an equivalent circle diameter of 500 nm or larger in the vicinity of a grain boundary in the austenite crystal grain is represented as Ngb, Ngb/Nc is less than 0.50. A more preferable Ngb/Nc is 0.40 or less. A still more preferable Ngb/Nc is 0.30 or less. Ngb/Nc may be 0.02 or more. In the case of the first embodiment, the number of the carbides that precipitate in the vicinity of the grain boundary in the austenite crystal grain is decreased by heating. This makes it possible to enhance the ductility of the metallographic structure. The heating time at 1000° C. is not particularly limited and is, for example, 30 minutes. In the cast austenitic stainless steel according to the first embodiment, Ngb/Nc may be less than 0.50 before heating at 1000° C.

(Method for Measuring Ngb/Nc)

Ngb/Nc can be measured by the following method. The cast austenitic stainless steel after being heated at 1000° C. is cut, and the cut face is etched with picric acid and hydrochloric acid and observed with an optical microscope (magnification: 1000 times). In the obtained observation image, 10 arbitrary sites are selected in the center portions of the crystal grains and 10 arbitrary sites are selected in the vicinities of the grain boundaries, respectively, and the number of the carbides having an equivalent circle diameter of 500 nm or larger in a 10 μm perfect circle is counted at each site. Nc is calculated from the obtained number of the carbides in the center portions and the area of the regions where the carbides have been measured. In addition, Ngb can be calculated from the obtained number of the carbides in the vicinities of the grain boundaries and the area of the regions where the carbides have been measured. Ngb/Nc is calculated from the obtained Ngb and Nc. The heating time at 1000° C. is not particularly limited and is, for example, 30 minutes.

(Average Width of Precipitation-Free Region Being 1.5 μm to 20 μm)

In a cross section of the cast austenitic stainless steel according to the first embodiment after being heated at 1000° C., a precipitation-free region, which is a region where the carbide is not observed in the optical microscopic observation at a magnification of 300 times, is present in the austenite crystal grain, and the width of the precipitation-free region is preferably 1.5 μm to 20 μm. Distortion of the precipitation-free region makes it possible to suppress the propagation of fissures by thermal stress.

(Method for Measuring Average Width of Precipitation-Free Region)

The average width of the precipitation-free region can be measured by the following method. The cast austenitic stainless steel after being heated at 1000° C. is cut, and the cut face is etched with picric acid and hydrochloric acid and observed with an optical microscope (magnification: 300 times). In the obtained observation image, 50 carbides having an equivalent circle diameter of 500 nm or larger in the vicinities of the grain boundaries in the austenite crystal grains are arbitrarily selected, and an inscribed circle between each carbide and the closest grain boundary is set. The average value of the diameters of the 50 set inscribed circles is calculated, and the average value is regarded as the average width of the precipitation-free region. The heating time at 1000° C. is not particularly limited and is, for example, 30 minutes.

(Chemical Composition)

The chemical composition of the cast austenitic stainless steel according to the first embodiment includes, for example, by mass %, C: 0.3% to 0.5%, Mn: 2.0% or less, P: 0.04% or less, S: 0.03% or less, Si: 1.0% to 2.5%, Ni: 36% to 39%, Cr: 18% to 21%, Mo: 0.5% or less and Nb: 1.2 to 1.8% with a remainder of iron and impurities. Hereinafter, each element will be described.

C: 0.3% to 0.5%

C is an element for forming the carbide. When the amount of C is less than 0.3%, there are cases where an appropriate amount of the carbides is not formed. Therefore, the amount of C is preferably 0.3% or more. When the amount of C is more than 0.5%, excess carbides are formed. Therefore, the amount of C is preferably 0.5% or less.

Mn: 2.0% or Less

Mn has a deoxidation effect and in addition, Mn is an element that contributes to the stabilization of austenite. However, when the amount of Mn is more than 2.0%, there are cases where the cast austenitic stainless steel embrittles. Therefore, the amount of Mn is preferably 2.0% or less. The amount of Mn is more preferably 1.5% or less. The amount of Mn is still more preferably 1.0% or less. There is no particular need to provide a lower limit for the amount of Mn; however, when the amount of Mn is extremely low, the deoxidation effect cannot be sufficiently obtained. Therefore, the amount of Mn is preferably 0.0001% or more.

P: 0.04% or Less

P is contained in the cast austenitic stainless steel as an impurity. When the amount of P is more than 0.04%, the ductility deteriorates. Therefore, the amount of P is preferably 0.04% or less. The amount of P is more preferably 0.03% or less and still more preferably 0.02% or less. Since P is an impurity, the amount of P is preferably reduced as much as possible; however, when the amount of P is extremely decreased, the manufacturing cost increases. Therefore, the amount of P is preferably set to 0.0001% or more and more preferably 0.0005% or more.

S: 0.03% or Less

S is contained in the cast austenitic stainless steel as an impurity. When the amount of S is more than 0.03%, there are cases where the ductility of the cast austenitic stainless steel deteriorates. Therefore, the amount of S is preferably 0.03% or less. A more preferable amount of S is 0.02% or less. S is an impurity and is thus preferably reduced as much as possible; however, when the amount of S is extremely decreased, the manufacturing cost increases. Therefore, the amount of S is preferably 0.0001% or more. The amount of S is more preferably 0.0005% or more.

Si: 1.0% to 2.5%

Si has a deoxidation effect and in addition, Si is an element that contributes to improvement in the corrosion resistance at high temperatures and the oxidation resistance. However, when the amount of Si becomes more than 2.5%, the stability of austenite deteriorates, and there are cases where the toughness deteriorates. Therefore, the amount of Si is preferably 2.5% or less. The amount of Si is more preferably 2.0% or less. The amount of Si is still more preferably 1.5% or less. When the amount of Si is less than 1.0%, there are cases where the deoxidation effect cannot be sufficiently obtained. Therefore, the amount of Si is preferably 1.0% or more. A more preferable amount of Si is 1.1% or more.

Ni: 36% to 39%

Ni is an effective element for obtaining austenite and is an element that contributes to the stability of austenite. In a case where the amount of Ni is less than 36%, there are cases where the above-described effects cannot be obtained. Therefore, the amount of Ni is preferably 36% or more. When a large amount of Ni is contained, the cost increases. Therefore, the amount of Ni is preferably 39% or less. The amount of Ni is more preferably 38% or less.

Cr: 18% to 21%

Cr contributes to improvement in the oxidation resistance at high temperatures and in addition, Cr is a necessary element to form the carbide. When the amount of Cr is less than 18%, there are cases where the above-described effects cannot be obtained. Therefore, the amount of Cr is preferably 18% or more. However, when the amount of Cr is more than 21%, there are cases where the stability of austenite at high temperatures deteriorates. Therefore, the amount of Cr is preferably 21% or less. A more preferable amount of Cr is 20% or less.

Mo: 0.5% or Less

Mo is a solid solution strengthening element. When the amount of Mo is more than 0.5%, there are cases where the stability of austenite deteriorates. Therefore, the amount of Mo is preferably 0.5% or less. The amount of Mo is more preferably 0.4% or less. In order to obtain the effect of Mo, the amount of Mo is preferably 0.01% or more.

Nb: 1.2 to 1.8%

Nb is an element that forms the carbide. When the amount of Nb is less than 1.2%, there are cases where appropriate carbides are not formed. Therefore, the amount of Nb is preferably 1.2% or more. The amount of Nb is more preferably 1.3% or more. When the amount of Nb is more than 1.8%, there are cases where a large amount of the carbides precipitate. Therefore, the amount of Nb is preferably 1.8% or less. The amount of Nb is more preferably 1.7% or less.

Remainder: Iron and Impurities

In the chemical composition of the cast austenitic stainless steel of the present disclosure, the remainder is iron and impurities. The impurity is a component that is mixed into a raw material or a producing step at the time of producing the cast austenitic stainless steel. The impurity is permitted to an extent that the effect of the cast austenitic stainless steel of the present disclosure can be obtained.

The chemical composition of the cast austenitic stainless steel can be analyzed using a well-known method. For example, the composition can be measured by inductively coupled plasma mass spectrometry or the like.

"Method for Producing Cast Austenitic Stainless Steel"

The cast austenitic stainless steel according to the first embodiment is produced by, for example, the following method. Composition elements that configure the cast austenitic stainless steel are melted, and the obtained molten metal is poured into a predetermined formwork; and thereby, a cast steel is obtained.

(Heating Step)

Next, a heating step of heating the obtained cast steel at a heating temperature of 1100° C. to 1250° C. is performed. When the heating temperature is in a temperature range of 1100° C. to 1250° C., the chemical elements of the cast austenitic stainless steel are uniformly solid-solubilized throughout all crystal grains, which is preferable. In addition, when the heating time is five minutes or longer, the chemical elements of the cast austenitic stainless steel are uniformly solid-solubilized throughout all crystal grains, which is preferable. The upper limit of the heating time is not particularly limited, but may be set to 60 minutes since changes rarely occur even when the cast steel is heated for 60 minutes or longer.

(Slow Cooling Step)

With regard to the cast steel on which the heating step has been performed, a slow cooling step of cooling the cast steel from the heating temperature to 500° C. at an average cooling rate of slower than 100° C./hour is performed. The average cooling rate is preferably 65° C./hour or slower.

During the slow cooling, elements precipitate and grow as a carbide. The carbide grows up to the equilibrium volume; however, once the equilibrium volume is reached, relatively small carbide disappears due to the Ostwald growth, and relatively large carbide grows. Since coarse carbides are present in grain boundaries, the elements in the vicinities of the grain boundaries gather into the coarse carbide present in the grain boundaries and grow; and thereby, an amount of carbides in the vicinities of the grain boundaries is decreased. This makes it possible to decrease an amount of coarse intergranular carbides when the cast austenitic stainless steel has been heated at 1000° C. and to achieve Ngb/Nc of less than 0.5, which is preferable. In addition, when the slow cooling step is performed, it is possible to make the carbide progress up to near the equilibrium precipitation state and to enhance the stability of the cast austenitic stainless steel during use at high temperatures.

Second Embodiment

A cast austenitic stainless steel according to a second embodiment will be described below.

(Nc=$6.0\times10^{-2}$ Particles/$\mu m^2$ or More)

In a cross section of the cast austenitic stainless steel according to the second embodiment when heated at 1000° C., the average number per unit area of carbides having an equivalent circle diameter of 500 nm or larger in the center portion of an austenite crystal grain is $6.0\times10^{-2}$ particles/$\mu m^2$ or more. The heating time at 1000° C. is not particularly limited and is, for example, 30 minutes. A more preferable average number per unit area of the carbides is $6.5\times10^{-2}$ particles/$\mu m^2$ or more. A still more preferable average number per unit area of the carbides is $7.0\times10^{-2}$ particles/$\mu m^2$ or more. In the present embodiment, since the precipitation of the carbides is controlled by a thermal treatment, the average number per unit area of the carbides having an equivalent circle diameter of 500 nm or larger in the center portion of the austenite crystal grain is $6.0\times10^{-2}$ particles/$\mu m^2$ or more.

The carbide is preferably $M_{23}C_6$ when a metal element is represented as M (M: Fe, Cr or Nb) and a carbon element is represented as C.

(Method for Measuring Nc)

Figure 2:
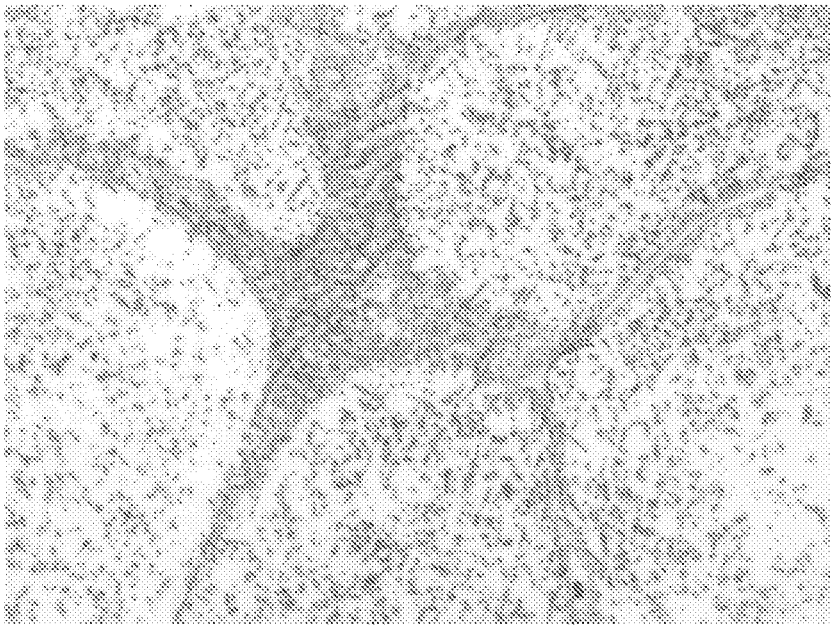
FIG. 2 is an optical microscopic image of a cast austenitic stainless steel according to a second embodiment of the present disclosure after heating.

The average number per unit area of the carbides can be measured by the same method as in the first embodiment. The cast austenitic stainless steel after being heated at 1000° C. is cut, and the cut face is etched with picric acid and hydrochloric acid and observed with an optical microscope (magnification: 1000 times). FIG. 2 is an optical microscopic image of the cast austenitic stainless steel according to the second embodiment after being heated at 1000° C. In the case of FIG. 2, the carbides appear as black regions in the center portion of an austenite crystal grain. At 10 arbitrary sites in the obtained observation image, the number of the carbides having an equivalent circle diameter of 500 nm or larger is counted, and the average number per unit area can be calculated from the obtained number of the carbides and the area of the regions where the carbides have been measured.

(Ngb/Nc: 0.50 to 1.30)

In a cross section of the cast austenitic stainless steel according to the second embodiment after being heated at 1000° C., when the average number per unit area of carbides having an equivalent circle diameter of 500 nm or larger in the center portion of an austenite crystal grain is represented as Nc, and the average number per unit area of carbides having an equivalent circle diameter of 500 nm or larger in the vicinity of a grain boundary in the austenite crystal grain is represented as Ngb, Ngb/Nc is 0.50 to 1.30. In the second embodiment, since the carbides uniformly precipitate in the austenite crystal grain, the strength and the reduction in area of the metallographic structure can be increased. The reduction in area refers to the amount of the cross-sectional area changed in the fracture site after a tensile test with respect to the cross-sectional area before the tensile test. A more preferable Ngb/Nc is 0.70 or more. A still more preferable Ngb/Nc is 0.85 or more. A more preferable Ngb/Nc is 1.05 or less. A still more preferable Ngb/Nc is 1.00 or less. The heating time at 1000° C. is not particularly limited and is, for example, 30 minutes.

(Method for Measuring Ngb/Nc)

Ngb/Nc can be measured by the following method. The cast austenitic stainless steel after being heated at 1000° C. is cut, and the cut face is etched with picric acid and hydrochloric acid and observed with an optical microscope (magnification: 1000 times). In the obtained observation image, 10 arbitrary sites are selected in the center portions of the austenite crystal grains and 10 arbitrary sites are selected in the vicinities of the grain boundaries, respectively, and the number of the carbides having an equivalent circle diameter of 500 nm or larger in a 10 μm perfect circle is counted at each site. Nc is calculated from the obtained number of the carbides in the center portions of the crystal grains and the area of the regions where the carbides have been measured. Ngb can be calculated from the obtained number of the carbides in the vicinities of the grain boundaries and the area of the regions where the carbides have been measured. Ngb/Nc is calculated from the obtained Ngb and Nc.

(Chemical Composition)

The chemical composition of the cast austenitic stainless steel according to the second embodiment includes, for example, by mass %, C: 0.3% to 0.5%, Mn: 2.0% or less, P: 0.04% or less, S: 0.03% or less, Si: 1.0% to 2.5%, Ni: 36% to 39%, Cr: 18% to 21%, Mo: 0.5% or less and Nb: 1.2 to 1.8% with a remainder of iron and impurities.

"Method for Producing Cast Austenitic Stainless Steel"

The cast austenitic stainless steel according to the second embodiment is produced by, for example, the following method. Composition elements that configure the cast austenitic stainless steel are melted, and the obtained molten metal is poured into a predetermined formwork; and thereby, a cast steel is obtained.

(Heating Step)

Next, a heating step of heating the obtained cast steel at a heating temperature of 1100° C. to 1250° C. is performed. When the heating temperature is in a temperature range of 1100° C. to 1250° C., the chemical elements of the cast austenitic stainless steel are uniformly solid-solubilized throughout all crystal grains, which is preferable. In addition, when the heating time is five minutes or longer, the chemical elements of the cast austenitic stainless steel are uniformly solid-solubilized throughout all crystal grains, which is preferable. The upper limit of the heating time is not particularly limited, but may be set to 60 minutes since changes rarely occur even when the cast steel is heated for 60 minutes or longer.

(Cooling Step)

With regard to the cast steel on which the heating step has been performed, a cooling step of cooling the cast steel from the heating temperature to 500° C. at an average cooling rate of 900° C./hour or faster is performed. The average cooling rate in the cooling step refers to the average of cooling rates from the heating temperature to 500° C. The average cooling rate is preferably set to 900° C./hour or faster in order to prevent the excess precipitation of the carbides during cooling.

Figure 3:
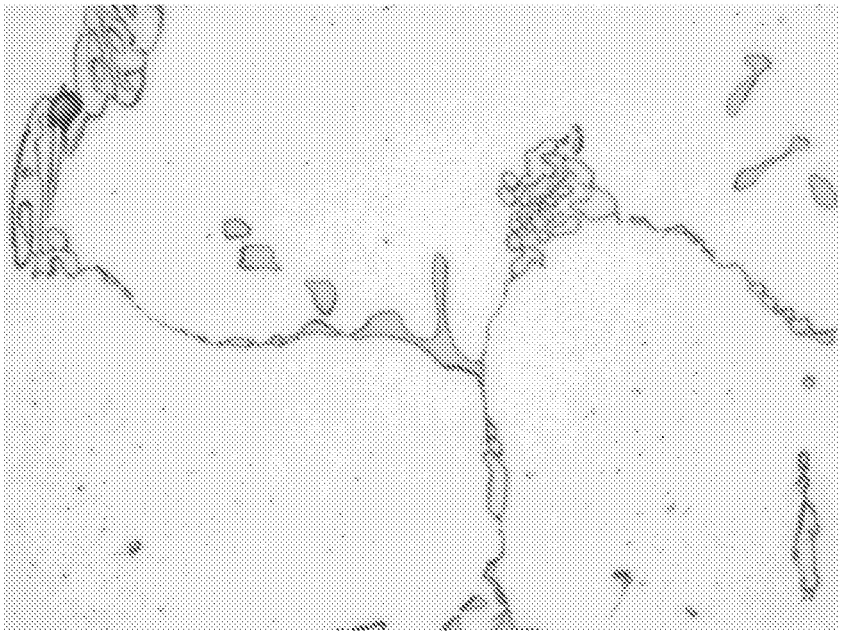
FIG. 3 is an optical microscopic image of the cast austenitic stainless steel according to the second embodiment of the present disclosure before heating.

An optical microscopic image of the obtained cast austenitic stainless steel of the second embodiment before heated at 1000° C. is shown in FIG. 3. As shown in FIG. 3, in a case where the cast austenitic stainless steel is produced by a production method according to the second embodiment, a part of intergranular carbides are solid-solubilized, and the structure is homogenized.

Third Embodiment

A cast austenitic stainless steel according to a third embodiment will be described below.

(Nc=$6.0\times10^{-2}$ Particles/$\mu m^2$ or More)

In a cross section of the cast austenitic stainless steel according to the third embodiment before heated at 1000° C., the average number per unit area of carbides having an equivalent circle diameter of 500 nm or larger in the center portion of an austenite crystal grain is $6.0\times10^{-2}$ particles/$\mu m^2$ or more. A more preferable average number per unit area of the carbides is $6.5\times10^{-2}$ particles/$\mu m^2$ or more. A still more preferable average number per unit area of the carbides is $7.0\times10^{-2}$ particles/$\mu m^2$ or more. In the present embodiment, since the precipitation of the carbides is controlled by a thermal treatment, the average number per unit area of the carbides having an equivalent circle diameter of 500 nm or larger in the center portion of the austenite crystal grain is $6.0\times10^{-2}$ particles/$\mu m^2$ or more. In addition, since the carbides precipitate in the cast austenitic stainless steel before heating, the strength at high temperatures improves. Even in the cast austenitic stainless steel of the third embodiment after being heated at 1000° C., the average number Nc per unit area of carbides having an equivalent circle diameter of 500 nm or larger in the center portion of an austenite crystal grain becomes $6.0\times10^{-2}$ particles/$\mu m^2$ or more.

The carbide is preferably $M_{23}C_6$ when a metal element is represented as M (M: Fe, Cr or Nb) and a carbon element is represented as C.

(Method for Measuring Nc)

Figure 4:
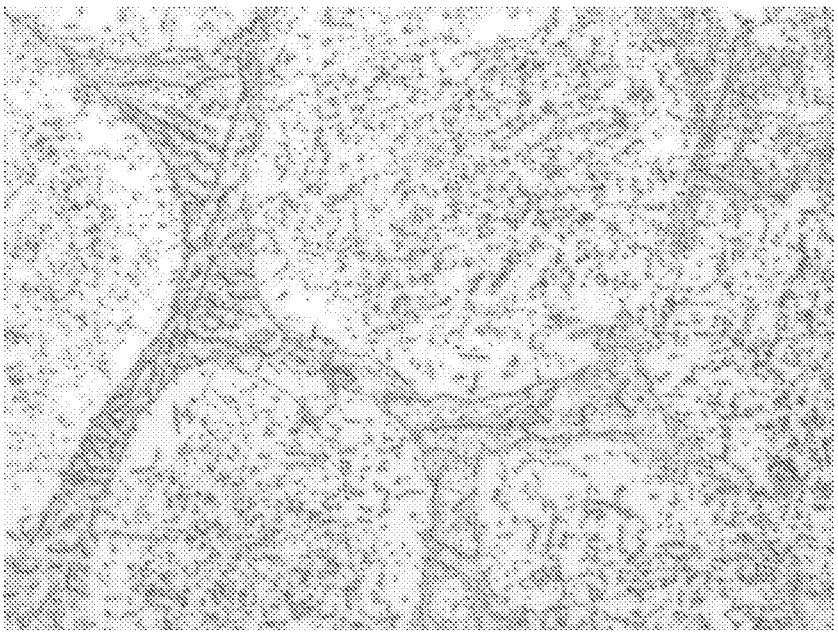
FIG. 4 is an optical microscopic image of a cast austenitic stainless steel according to a third embodiment of the present disclosure before heating.

The average number per unit area of the carbides can be measured by the following method. The cast austenitic stainless steel before heated at 1000° C. is cut, and the cut face is etched with picric acid and hydrochloric acid and observed with an optical microscope (magnification: 1000 times). FIG. 4 is an optical microscopic image of the cast austenitic stainless steel according to the third embodiment. In the case of FIG. 4, the carbides appear as black regions in the center portion of an austenite crystal grain. At 10 arbitrary sites in the obtained observation image, the number of the carbides having an equivalent circle diameter of 500 nm or larger is counted, and the average number per unit area can be calculated from the obtained number of the carbides and the area of the regions where the carbides have been measured.

(Ngb/Nc: 0.50 to 1.30)

In a cross section of the cast austenitic stainless steel according to the third embodiment before heated at 1000° C., when the average number per unit area of carbides having an equivalent circle diameter of 500 nm or larger in the center portion of an austenite crystal grain is represented as Nc, and the average number per unit area of carbides having an equivalent circle diameter of 500 nm or larger in the vicinity of a grain boundary in the austenite crystal grain is represented as Ngb, Ngb/Nc is 0.50 to 1.30. In the third embodiment, since the carbides uniformly precipitate in the austenite crystal grain before heating, the structural stability during use at high temperatures improves, and it is possible to improve the reduction in area. In addition, it is possible to suppress cracking from crystal grain boundaries caused by repetitive thermal stress and to reduce the amount of plastic deformation during the exertion of thermal stress. A more preferable Ngb/Nc is 0.70 or more. A still more preferable Ngb/Nc is 0.85 or more. A more preferable Ngb/Nc is 1.05 or less. A still more preferable Ngb/Nc is 1.00 or less. In the cast austenitic stainless steel of the third embodiment, Ngb/Nc becomes 0.50 to 1.30 even after the cast austenitic stainless steel is heated at 1000° C.

(Method for Measuring Ngb/Nc)

Ngb/Nc can be measured by the following method. The cast austenitic stainless steel before heated at 1000° C. is cut, and the cut face is etched with picric acid and hydrochloric acid and observed with an optical microscope (magnification: 1000 times). In the obtained observation image, 10 arbitrary sites are selected in the center portions of the crystal grains and 10 arbitrary sites are selected in the vicinities of the grain boundaries, respectively, and the number of the carbides having an equivalent circle diameter of 500 nm or larger in a 10 μm perfect circle is counted at each site. Nc is calculated from the obtained number of the carbides in the center portions and the area of the regions where the carbides have been measured. Ngb can be calculated from the obtained number of the carbides in the vicinities of the grain boundaries and the area of the regions where the carbides have been measured. Ngb/Nc is calculated from the obtained Ngb and Nc.

(Chemical Composition)

The chemical composition of the cast austenitic stainless steel according to the third embodiment includes, for example, by mass %, C: 0.3% to 0.5%, Mn: 2.0% or less, P: 0.04% or less, S: 0.03% or less, Si: 1.0% to 2.5%, Ni: 36% to 39%, Cr: 18% to 21%, Mo: 0.5% or less and Nb: 1.2 to 1.8% with a remainder of iron and impurities.

"Method for Producing Cast Austenitic Stainless Steel"

The cast austenitic stainless steel according to the third embodiment is produced by, for example, the following method. Composition elements that configure the cast austenitic stainless steel are melted, and the obtained molten metal is poured into a predetermined formwork; and thereby, a cast steel is obtained.

(Heating Step)

Next, a heating step of heating the obtained cast steel at a heating temperature of 1100° C. to 1250° C. is performed. When the heating temperature is in a temperature range of 1100° C. to 1200° C., the chemical elements of the cast austenitic stainless steel are uniformly solid-solubilized throughout all crystal grains, which is preferable. In addition, when the heating time is five minutes or longer, the chemical elements of the cast austenitic stainless steel are uniformly solid-solubilized throughout all crystal grains, which is preferable. The upper limit of the heating time is not particularly limited, but may be set to 60 minutes since changes rarely occur even when the cast steel is heated for 60 minutes or longer.

(Cooling Step)

With regard to the cast steel on which the heating step has been performed, a cooling step of cooling the cast steel from the heating temperature to 500° C. at an average cooling rate of 900° C./hour or faster is performed. The average cooling rate in the cooling step refers to the average of cooling rates from the heating temperature to 500° C. The average cooling rate is preferably set to 900° C./hour or faster in order to prevent the excess precipitation of the carbides during cooling.

(Aging Step)

Next, an aging step of heating the obtained cast steel in a temperature range (aging temperature) of 900° C. to 1050° C. for one hour or longer is performed. When the aging temperature is in a temperature range of 900° C. to 1050° C., uniform carbides can be precipitated, which is preferable. In addition, when the heating time is one hour or longer, uniform carbides can be precipitated, which is preferable.

(Second Cooling Step)

With regard to the cast steel on which the aging step has been performed, a second cooling step of cooling the cast steel from the aging temperature to 500° C. at an average cooling rate of 900° C./hour or faster is performed. The average cooling rate in the second cooling step refers to the average of cooling rates from the aging temperature to 500° C. The average cooling rate is preferably set to 900° C./hour or faster in order to prevent the excess precipitation of the carbides during cooling.

In the method for producing the cast austenitic stainless steel according to each embodiment described above, a well-known step may be combined.

EXAMPLES

Hereinafter, the present invention will be more specifically described using examples, but the present invention is not limited thereto.

Example 1

A cast of an austenitic stainless steel having a chemical composition including, by mass %, C: 0.34%, Mn: 0.89%, P: 0.021%, S: 0.007%, Si: 1.13%, Ni: 36.33%, Cr: 18.77%, Mo: 0.02% and Nb: 1.28% with a remainder of iron and impurities was heated at a heating temperature of 1250° C. for 60 minutes and, after being heated, the cast was cooled from 1250° C. to 500° C. at an average cooling rate of 65° C./hour; and thereby, a cast austenitic stainless steel of Example 1 was obtained.

Example 2

A cast of an austenitic stainless steel having a chemical composition including, by mass %, C: 0.34%, Mn: 0.89%, P: 0.021%, S: 0.007%, Si: 1.13%, Ni: 36.33%, Cr: 18.77%, Mo: 0.02% and Nb: 1.28% with a remainder of iron and impurities was heated at a heating temperature of 1250° C. for 60 minutes and, after being heated, the cast was cooled from 1250° C. to 500° C. at an average cooling rate of 4000° C./hour; and thereby, a cast austenitic stainless steel of Example 2 was obtained.

Example 3

A cast of an austenitic stainless steel having a chemical composition including, by mass %, C: 0.34%, Mn: 0.89%, P: 0.021%, S: 0.007%, Si: 1.13%, Ni: 36.33%, Cr: 18.77%, Mo: 0.02% and Nb: 1.28% with a remainder of iron and impurities was heated at a heating temperature of 1250° C. for 60 minutes and, after being heated, the cast was cooled from 1250° C. to 500° C. at an average cooling rate of 4000° C./hour. After the cooling, an aging treatment was performed at 950° C. for 600 minutes, and the cast was cooled from 950° C. to 500° C. at an average cooling rate of 3200° C./hour; and thereby, a cast austenitic stainless steel of Example 3 was obtained.

Comparative Example 1

A cast of an austenitic stainless steel having a chemical composition including, by mass %, C: 0.34%, Mn: 0.89%, P: 0.021%, S: 0.007%, Si: 1.13%, Ni: 36.33%, Cr: 18.77%, Mo: 0.02% and Nb: 1.28% with a remainder of iron and impurities was used as a cast austenitic stainless steel of Comparative Example 1 without performing any treatments thereon.

(Nc and Ngb/Nc After Heating)

The ratios of Ngb/Nc of the cast austenitic stainless steels of Examples 1 to 3 and Comparative Example 1 after heating were measured by the following method. The cast austenitic stainless steel heated at 1000° C. for 30 minutes was cut, and the cut face was etched with picric acid and hydrochloric acid and observed with an optical microscope (magnification: 1000 times). In the obtained observation image, 10 arbitrary sites were selected in the center portions of the crystal grains and 10 arbitrary sites were selected in the vicinities of the grain boundaries, respectively, and the number of the carbides having an equivalent circle diameter of 500 nm or larger in a 10 μm perfect circle was counted at each site. Nc was calculated from the obtained number of the carbides in the center portions and the area of the regions where the carbides had been measured. Ngb was calculated from the obtained number of the carbides in the vicinities of the grain boundaries and the area of the regions where the carbides had been measured. Ngb/Nc was calculated from the obtained Ngb and Nc. The results are shown in Table 1.

(Width of Precipitation-Free Region After Heating)

The average width of precipitation-free region in the cast austenitic stainless steel of Example 1 can be measured by the following method. The cast austenitic stainless steel after being heated at 1000° C. for 30 minutes was cut, and the cut face was electrolytically corroded with nitric acid and observed with an optical microscope (magnification: 300 times). In the obtained observation image, 50 carbides having an equivalent circle diameter of 500 nm or larger in the vicinities of the grain boundaries in the austenite crystal grains were arbitrarily selected, and an inscribed circle between each carbide and the closest grain boundary was set. The average value of the diameters of the 50 set inscribed circles was calculated, and the average value was regarded as the average width of the precipitation-free region. The results are shown in Table 1. In Table 1, the value of 0.0 indicates that there was no precipitation-free region.

(0.2% Proof Stress)

The 0.2% proof stress at high temperatures was measured according to JIS G 0567:2012. Regarding the shape of a test piece, the flanged test piece described in Appendix A.5 of JIS G 0567:2012 was used. The testing temperature was set to 1000° C.

The results are shown in Table 1.

(Tensile Strength)

The tensile strength at high temperatures was measured according to JIS G 0567:2012. Regarding the shape of a test piece, the flanged test piece described in Appendix A.5 of JIS G 0567:2012 was used. The testing temperature was set to 1000° C. The results are shown in Table 1.

(Elongation)

The elongation at high temperatures was measured according to JIS G 0567:2012. As the elongation, breaking elongation was measured. Regarding the shape of a test piece, the flanged test piece described in Appendix A.5 of JIS G 0567:2012 was used. The testing temperature was set to 1000° C. The results are shown in Table 1.

(Reduction in Area)

The reduction in area at high temperatures was measured according to JIS G 0567:2012. Regarding the shape of a test piece, the flanged test piece described in Appendix A.5 of JIS G 0567:2012 was used. The testing temperature was set to 1000° C. The results are shown in Table 1.

TABLE 1

| | Thermal treatment | Ngb/Nc after heating | Nc after heating (pieces/μm$^2$) | Width of precipitation-free region after heating (μm) | 0.2% Proof stress (MPa) | Tensile strength (MPa) | Elongation (%) | Reduction in area (%) |
|---|---|---|---|---|---|---|---|---|
| Comparative Example | As cast | 1.8 | 0.07 | 0.0 | 58 | 89 | 25 | 66 |
| Example 1 | Solution treatment + slow cooling | 0.1 | 0.10 | 9.3 | 46 | 80 | 38.5 | 66 |
| Example 2 | Solution treatment + air cooling | 0.9 | 0.19 | 0.0 | 73 | 104 | 20 | 72 |
| Example 3 | Solution treatment + aging | 0.5 | 0.28 | 0.0 | 62 | 93 | 23 | 73 |

The above-described results show that the cast austenitic stainless steels of Examples 1 to 3 according to the present embodiment were superior in terms of heat resistance to the cast austenitic stainless steel of Comparative Example 1.

In the cast austenitic stainless steel of Example 1, the average number Nc per unit area of the carbides having an equivalent circle diameter of 500 nm or larger after heating was $6.0\times10^{-2}$ particles/μm$^2$ or more, and Ngb/Nc was less than 0.50. Therefore, the elongation was excellent. In addition, as a result of observing the metallographic structure after the high-temperature tensile test, it was found that the excess precipitation of the carbides was prevented, whereby the propagation of fissures along the intergranular carbides was rarely recognized, fissures propagated into the crystal grains, and thus it was possible to suppress embrittlement.

In the cast austenitic stainless steel of Example 2, the average number Nc per unit area of the carbides having an equivalent circle diameter of 500 nm or larger after heating was $6.0\times10^{-2}$ particles/μm$^2$ or more, and Ngb/Nc was within a range of 0.50 to 1.30. Therefore, the 0.2% proof stress, the tensile strength and the reduction in area were excellent. It was found that, since the reduction in area was excellent after the high-temperature tensile test, the ductility improved, and it was possible to suppress embrittlement.

In the cast austenitic stainless steel of Example 3, the average number Nc per unit area of the carbides having an equivalent circle diameter of 500 nm or larger after heating was $6.0\times10^{-2}$ particles/μm$^2$ or more, and Ngb/Nc was within a range of 0.50 to 1.30. Therefore, the 0.2% proof stress, the tensile strength and the reduction in area were excellent. It was found that, since the reduction in area was excellent after the high-temperature tensile test, the ductility improved, and it was possible to suppress embrittlement. While not shown in Table 1, even in the cross section of the cast austenitic stainless steel of Example 3 before heated at 1000° C., Nc was $6.0\times10^{-2}$ particles/μm$^2$ or more, and Ngb/Nc was within a range of 0.50 to 1.30.

Based on the above description, the cast austenitic stainless steel of the present disclosure was excellent in terms of heat resistance.

SUPPLEMENTARY NOTES

The cast austenitic stainless steels and the methods for producing a cast austenitic stainless steel described in the above-described embodiments can be understood as described below.

(1) In a cast austenitic stainless steel according to a first aspect of the present disclosure, in a cross section when heated at 1000° C., an average number Nc per unit area of carbides having an equivalent circle diameter of 500 nm or larger in a center portion of an austenite crystal grain is $6.0\times10^{-2}$ particles/μm$^2$ or more, and, when an average number per unit area of the carbides having an equivalent circle diameter of 500 nm or larger in a vicinity of a grain boundary in an austenite crystal grain is represented as Ngb, Ngb/Nc is 1.30 or less.

In such a case, it is possible to suppress the embrittlement of the cast austenitic stainless steel.

(2) A cast austenitic stainless steel according to a second aspect of the present disclosure is the cast austenitic stainless steel of (1), in which the Ngb/Nc is less than 0.5.

In such a case, it is possible to suppress the embrittlement of the cast austenitic stainless steel. In addition, it is possible to improve the elongation at high temperatures of the cast austenitic stainless steel.

(3) A cast austenitic stainless steel according to a third aspect of the present disclosure is the cast austenitic stainless steel of (2), in which a precipitation-free region, which is a region where the carbide is not observed in an optical microscopic observation at a magnification of 300 times, is present, and a width of the precipitation-free region is 1.5 μm to 20 μm.

In such a case, it is possible to further improve the elongation at high temperatures of the cast austenitic stainless steel.

(4) A cast austenitic stainless steel according to a fourth aspect of the present disclosure is the cast austenitic stainless steel of (1), in which the Ngb/Nc is 0.50 to 1.30.

In such a case, it is possible to suppress the embrittlement of the cast austenitic stainless steel. In addition, it is possible to improve the 0.2% proof stress, the tensile strength and the reduction in area.

(5) A cast austenitic stainless steel according to a fifth aspect of the present disclosure is the cast austenitic stainless steel of (1), in which, in a cross section before heating at 1000° C., an average number Nc per unit area of carbides having an equivalent circle diameter of 500 nm or larger in a center portion of an austenite crystal grain is $6.0\times10^{-2}$ particles/μm$^2$ or more, and, when an average number per unit area of the carbides having an equivalent circle diameter of 500 nm or larger in a vicinity of a grain boundary in an austenite crystal grain is represented as Ngb, Ngb/Nc is 0.50 to 1.30.

In such a case, it is possible to suppress the embrittlement of the cast austenitic stainless steel. In addition, it is possible to improve the 0.2% proof stress, the tensile strength and the reduction in area.

(6) A cast austenitic stainless steel according to a sixth aspect of the present disclosure is the cast austenitic stainless steel of any one of (1) to (5), in which a chemical composition of the cast austenitic stainless steel includes, by mass %, C: 0.3% to 0.5%, Mn: 2.0% or less, P: 0.04% or less, S: 0.03% or less, Si: 1.0% to 2.5%, Ni: 36% to 39%, Cr: 18% to 21%, Mo: 0.5% or less and Nb: 1.2 to 1.8% with a remainder of iron and impurities.

In such a case, it is possible to further suppress the embrittlement of the cast austenitic stainless steel.

(7) A method for producing a cast austenitic stainless steel according to a seventh aspect of the present disclosure includes a heating step of heating a cast austenitic stainless steel after casting at a heating temperature of 1100° C. to 1250° C.

In such a case, it is possible to uniformly solid-solubilize elements throughout all crystal grains.

(8) A method for producing a cast austenitic stainless steel according to an eighth aspect of the present disclosure is the method for producing a cast austenitic stainless steel of (7), including, after the heating step, a slow cooling step of cooling the cast austenitic stainless steel from the heating temperature to 500° C. at an average cooling rate of slower than 100° C./hour.

In such a case, it is possible to make the carbides progress up to near the equilibrium precipitation state and to enhance the stability of the cast austenitic stainless steel during use at high temperatures.

(9) A method for producing a cast austenitic stainless steel according to a ninth aspect of the present disclosure is the method for producing a cast austenitic stainless steel of (7), including, after the heating step, a cooling step of cooling the cast austenitic stainless steel from the heating temperature to 500° C. at an average cooling rate of 900° C./hour or faster.

In such a case, it is possible to prevent carbides from excessively precipitating during cooling.

(10) A method for producing a cast austenitic stainless steel according to a tenth aspect of the present disclosure is the method for producing a cast austenitic stainless steel of (9), including, after the cooling step, an aging step of heating the cast austenitic stainless steel in a temperature range of 900° C. to 1050° C. for one hour or longer and a second cooling step of cooling the cast austenitic stainless steel from the temperature range in the aging step to 500° C. at an average cooling rate of 900° C./hour or faster.

In such a case, it is possible to precipitate uniform carbides in an austenite crystal grain.

(11) A method for producing a cast austenitic stainless steel according to an eleventh aspect of the present disclosure is the method for producing a cast austenitic stainless steel of any one of (7) to (10), in which the chemical composition of the cast austenitic stainless steel includes, by mass %, C: 0.3% to 0.5%, Mn: 2.0% or less, P: 0.04% or less, S: 0.03% or less, Si: 1.0% to 2.5%, Ni: 36% to 39%, Cr: 18% to 21%, Mo: 0.5% or less and Nb: 1.2 to 1.8% with a remainder of iron and impurities.

In such a case, it is possible to further suppress the embrittlement of the cast austenitic stainless steel.

What is claimed is:

1. A cast austenitic stainless steel, wherein, in a cross section when heated at 1000° C., an average number Nc per unit area of carbides having an equivalent circle diameter of 500 nm or larger in a center portion of an austenite crystal grain is $6.0\times10^{-2}$ particles/$\mu m^2$ or more, and when an average number per unit area of the carbides having an equivalent circle diameter of 500 nm or larger in a vicinity of a grain boundary in an austenite crystal grain is represented as Ngb, Ngb/Nc is 1.30 or less.

2. The cast austenitic stainless steel according to claim 1, wherein the Ngb/Nc is less than 0.5.

3. The cast austenitic stainless steel according to claim 2, wherein a precipitation-free region, which is a region where the carbide is not observed in an optical microscopic observation at a magnification of 300 times, is present, and a width of the precipitation-free region is 1.5 μm to 20 μm.

4. The cast austenitic stainless steel according to claim 1, wherein the Ngb/Nc is 0.50 to 1.30.

5. The cast austenitic stainless steel according to claim 1, wherein, in a cross section before heating at 1000° C., an average number Nc per unit area of carbides having an equivalent circle diameter of 500 nm or larger in a center portion of an austenite crystal grain is $6.0\times10^{-2}$ particles/$\mu m^2$ or more, and when an average number per unit area of the carbides having an equivalent circle diameter of 500 nm or larger in a vicinity of a grain boundary in an austenite crystal grain is represented as Ngb, Ngb/Nc is 0.50 to 1.30.

6. The cast austenitic stainless steel according to claim 1, wherein a chemical composition of the cast austenitic stainless steel comprises, by mass %, C: 0.3% to 0.5%,
Mn: 2.0% or less,
P: 0.04% or less,
S: 0.03% or less,
Si: 1.0% to 2.5%,
Ni: 36% to 39%,
Cr: 18% to 21%,
Mo: 0.5% or less, and
Nb: 1.2 to 1.8%, with a remainder being iron and impurities.

* * * * *